United States Patent [19]

Ulmann

[11] 4,370,825

[45] Feb. 1, 1983

[54] DEVICES OF THE TURNSTILE KIND FOR CONTROLLING PASSAGES REQUIRING AUTHORIZATION

[75] Inventor: Jean-Pierre Ulmann, Paris, France

[73] Assignee: Etablissements Georges Klein, France

[21] Appl. No.: 151,457

[22] Filed: May 19, 1980

[51] Int. Cl.[3] ..... E06B 11/08

[52] U.S. Cl. ..... 49/47

[58] Field of Search ..... 49/42, 46, 47; 74/55, 74/57, 567, 569, 816, 820

[56] References Cited

U.S. PATENT DOCUMENTS

| | | | |
|---|---|---|---|
| 1,495,285 | 5/1924 | Wilkin | 49/46 |
| 3,397,486 | 8/1968 | Foxwell et al. | 49/47 |
| 3,731,545 | 5/1973 | Beezer | 74/57 X |
| 3,978,613 | 9/1976 | Hayward et al. | 49/47 X |

FOREIGN PATENT DOCUMENTS

| | | | |
|---|---|---|---|
| 549511 | 12/1957 | Canada | 49/47 |
| 2045128 | 2/1971 | France . | |

*Primary Examiner*—Philip G. Kannan

*Attorney, Agent, or Firm*—Larson and Taylor

[57] ABSTRACT

It is a question of bringing resiliently and successively the arms of a turnstile to their position obstructing a passage to be controlled, and for this a rotary cam 1 in the shape of a star is used interlocked with the rotary assembly of the turnstile and a roller 2 resiliently applied against this cam.

To avoid lifting-off between the roller and the cam, a second contact is used between a second roller 2 connected to the first roller or merging therewith and a second cam 10 connected to the first cam or merged therewith, the directions of application of the two roller-cam contacts being opposite.

The invention applies to controlling access to urban rail networks.

2 Claims, 2 Drawing Figures

DEVICES OF THE TURNSTILE KIND FOR CONTROLLING PASSAGES REQUIRING AUTHORIZATION

Figure 1:
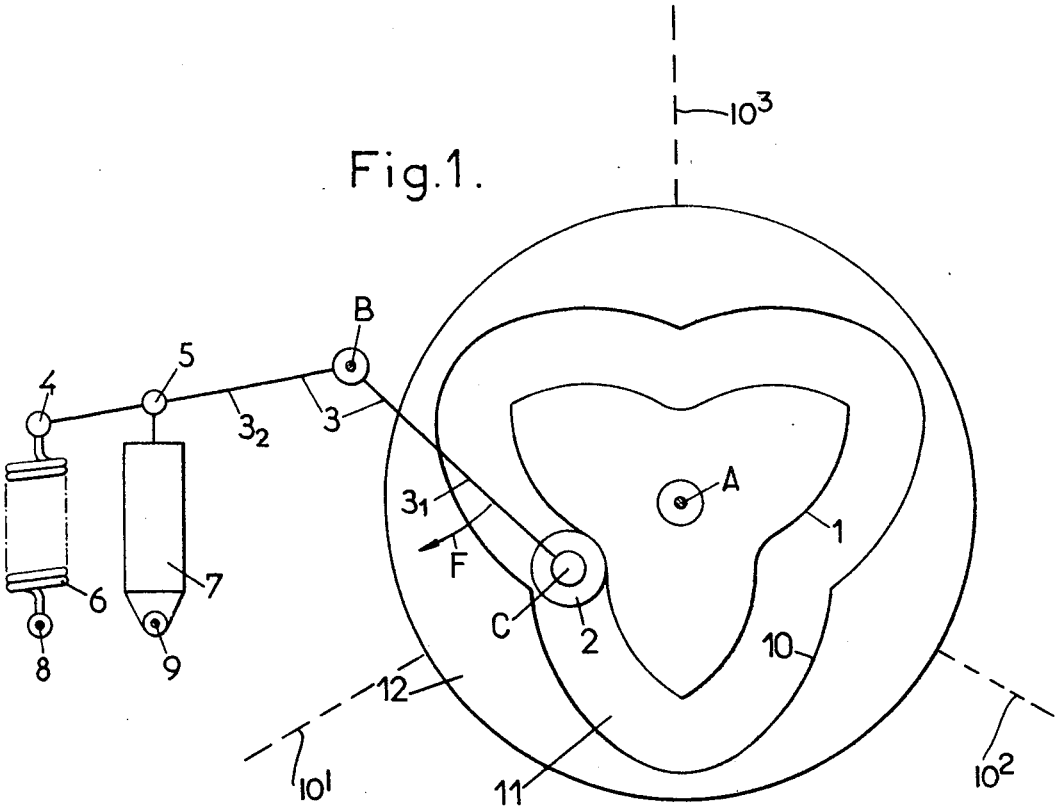

The invention relates to devices of the turnstile type for controlling the passage of people through narrow openings by means of mechanical barriers adapted to stop up these openings at will, and it relates more particularly though not exclusively, among these devices, to those which are adapted to controlling passages giving access to paying enclosures, such for example as those containing urban rail networks.

It concerns more especially those of the devices considered comprising a rotary barrier-supporting member, means for ensuring the locking of this member in one of its obstructing positions when the passage is not authorized and return means for bringing said rotary member, after each passage resulting in the retraction of a barrier, back to a stable angular obstructing position for which a new barrier obstructs the passage, these return means comprising a star-shaped cam interlocked angularly with the rotary member and a return finger, generally formed by a roller, applied resiliently against this cam.

The cam return means in question generally gives satisfaction but, in certain cases, it happens that at the end of travel, i.e. when the return finger reaches the bottom of a notch between two consecutive arms of the star-shaped cam, this finger overshoots this position, then returns thereto while lifting off the cam following a sudden reversal of the rotational direction of said cam, due precisely to this overshooting, which causes undesirable bouncing of the finger against the cam: this is the case in particular when the control device considered is arranged so that on the one hand no locking is normally provided for its rotary member in the rest position and that, on the other hand, damping is provided for the movements of the support of the finger and not for those of the cam. Such control devices, to which the invention relates preferably, have been for example described in French Pat. No. 1 588 975 belonging to the Applicant.

The invention has as an aim especially to prevent such lifting off.

For this purpose, the return means of the invention are essentially characterized in that they comprise, in addition to the rotary cam and the finger cooperating with this cam, a second cam angularly interlocked with the first cam and a second finger connected to the first finger and adapted to cooperate with the second cam so that the direction of application of the two fingers against their respective cams are opposed, i.e. that the contact of the second finger against the second cam opposes the loss of contact between the first finger and the first cam.

In the preferred embodiments, recourse is had to one and/or the other of the following arrangements:

the first finger is carried by a lever pivotably mounted about a fixed shaft B parallel to the one A of the first cam and this lever is associated, on the one hand with resilient means which urge it angularly about shaft B in the direction corresponding to the application of the first finger against the first cam and, on the other hand, with means adapted to damp its angular movements, the first finger is carried by a slide guided so as to be able to move along an axis intersecting that of the cam and perpendicular thereto, in a control device according to the preceding paragraph, the two cams are merged into a single cam and the two fingers jointingly encircle this cam, the second cam delimits with the first cam a groove having over at least the greatest part of its extent a constant width equal to that of the first finger and thus adapted to jointingly encircle this first finger, which forms at the same time the second finger, the two cams are superimposed axially along the same axis, each contact between a finger and the corresponding cam is achieved, in a way known per se, by a roller forming said finger rolling on this cam, the control device is a three-arm turnstile and the active range of each cam presents three identical portions connected together and mutually staggered by 120° about the axis of the cam.

The invention comprises, apart from these principal arrangements, certain other arrangements which are preferably used at the same time and which will be more explicitly discussed hereafter.

In what follows, there will be described two preferred embodiments of the invention with reference to the accompanying drawing in a way which is of course non-limiting.

Figure 2:
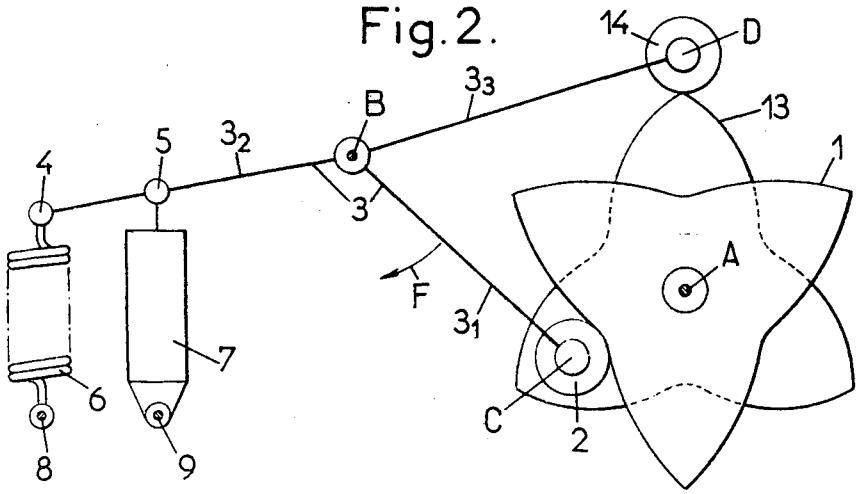

FIGS. 1 and 2 of this drawing show schematically two portions of three-arm turnstiles constructed in accordance with the invention.

In a way known per se, each of these turnstiles comprises an assembly of three arms (not shown) interlocked angularly with a hub having a fixed axis A and capable in turn of occupying a horizontal position corresponding to the blocking or obstructing of a narrow passage giving access to a paying enclosure.

In a way also known per se, means are provided for locking each arm in its said obstructing position, at least in one of the two possible directions of its movements about axis A, and to allow on the contrary this arm to be pushed and retracted in the direction considered in response to an appropriate authorization: this authorization is given concrete form particularly by insertion of a token or other valid voucher (for example a rectangle of cardboard on which is printed magnetic information) in a slot of the housing surrounding the turnstile.

This retraction of each arm is immediately followed by the following arm of the turnstile coming into its horizontal obstructing position, the angular spacing between the two successive arms being sufficient to accommodate individually the persons who take the concerned passage: the freeing of the passage then requires a new authorization and so on.

The appearance of each arm in its stable obstructing position is ensured by the relaxation of resilient return means which are loaded by the effort made by the passenger to retract the arm opposing his passage.

These means comprise:

a rotary cam 1 with axis A in the form of a star having three thick branches interlocked with the arms of the turnstile in rotation about said axis, and a roller 2 urged resiliently against this cam 1 in a radial or substantially radial direction in relation to axis A.

In the illustrated embodiments, this roller 2 is carried by the end of an arm $3_1$ of a rigid lever 3 which is pivotably mounted about a fixed axis B parallel to axis A, the other arm $3_2$ of said lever being coupled by a joint at 4 and 5 respectively to a spring 8 and a damper 7 themselves hitched to fixed points 8 and 9 of the frame of the turnstile.

These known return means give generally satisfaction, but under certain conditions, if no mechanical locking is normally provided for the barriers in their obstructing positions, there can be observed at the end of the return of these arms in these positions losses of contact between roller and cam, which causes undesirable disorders such as noises, wear, in addition to swinging and floating of said arms.

These losses of contact are made impossible, or practically so, in accordance with the invention, by means of a second contact exerted in the opposite direction to the preceding one between a second roller integral with lever 3 and a second cam integral with cam 1.

Two embodiments of such an arrangement have been shown respectively in FIGS. 1 and 2.

In the embodiment of FIG. 1, a second cam 10 delimits with the first one 1 a groove 11 having over the greatest part of its extent a constant width equal to the diameter of roller 2 and so adapted to joiningly receive this roller.

In this case said roller 2 forms both the first and the second roller mentioned in the above definitions.

Groove 11 may be hollowed out in one of the faces of the disc 12 having axis A.

Roller 2 is then mounted on a pivot having an axis C parallel to axes A and B, cantilever mounted at the end of the lever arm $3_2$ and plunging axially into groove 11.

It will be readily understood that with such a mounting, the abutment of roller 2 against the outer face of groove 11 prevents this latter from lifting off the inner face 1 of said groove.

The operation of this mechanism is the following.

Initially, roller 2 is applied by the force of spring 6 at the bottom of one of the notches disposed between two contiguous branches of the star-shaped cam 1, as can be seen in FIG. 1.

For this relative position between the roller and the cam, one of the arms of the turnstile extends horizontally across the passage to be controlled and so obstructs it.

When a user who has produced in any desirable way the prooof that he has been authorized to use the passage pushes said arm, this latter retracts progressively and its rotation about axis A also causes disc 12 to rotate, which angularly urges roller 2 and lever 3 in the direction of arrow F and loads spring 6.

This phase for loading the return means corresponds to the angular movement of 60° of disc 12 about axis A during which roller 2 rolls against a first face of a branch of the star-cam 1 from the bottom of the notch which corresponds to the root of this branch up to the top of this latter.

At the end of this loading phase, cam 1 presents the tip of its said branch in contact with roller 2.

From this moment, the user releases the turnstile and it is the relaxation of spring 6 loaded during the above phase which, through roller 2 rolling against the second face of the above-mentioned branch, angularly urges this latter, as well as all the mobile part of the turnstile which is integral therewith, towards its next stable angular position while urging lever 3 and roller 2 which it carries in the direction opposite that of arrow F.

When it reaches its new stable angular position, the rotary assembly comprising the arms of the turnstile and the cams has described an angle of 120° about axis A from the preceding stable position, and roller 2 is then again at the bottom of a notch of cam 1 without at any time losing contact therewith.

The turnstile is then ready to control a new passage and so on.

It may be remarked that at the level of each notch bottom of cam 1, the width of groove 11, if it is considered in the corresponding radial direction of disc 12, is a little greater than the diameter of roller 2: this dimensioning is necessary to avoid the jamming of the roller in the groove, at the level of these bottoms, but does not form a disadvantage in practice, for the lifting-off to be avoided corresponds to positions of the roller distant from the bottoms of the notches.

It should be noted that the above-described mechanism ensures the successive returns of the different arms of the turnstile to their obstructing positions in the same way and with the same efficiency whatever the direction of rotation of this turnstile about axis A.

This indifferent adaptation to the two directions of rotation of the turnstile constitutes an important advantage in practice.

The second variation illustrated in FIG. 2 avoids recourse to a hollow cam.

The second cam 13 locked in rotation with the first cam 1 presents here, like this first cam, an external peripheral rolling surface.

A second roller 14 is pivotably mounted about an axis D parallel to axes A, B, C on an additional arm $3_3$ of lever 3 so as to come into contact with the second cam 13.

With respect to axis B of the lever, the angular directions in which the two rollers 2 and 14 are applied to their respective cams 1 and 13 are opposite: consequently, the contact between roller 14 and cam 13 prevents any loss of contact between roller 2 and cam 1.

Of course, the profile of cam 13 is determined depending on that of cam 1 so that the two roller-cam rolling contacts are constantly provided without excessive urging, the distance between the two zones of contact remaining then constant during rotation of the cams.

Everything takes place then as if the rigid fork formed by the assembly of the two arms $3_1$ and $3_3$ of lever 3 overlapping the assembly of the two cams were solely subjected to an angular swinging movement about axis B during rotation of the turnstile, each swing of this lever corresponding to a rotation of 120° of the cams and so of the turnstile.

The operation of this second embodiment is in effect identical to that described with connection to the first embodiment illustrated in FIG. 1 except for the following difference:

in the first case, the contact between cam 1 and roller 2 which transmits thereto the return force is maintained by the roller being jointingly encircled by a double cam, in the second case the cam 1-roller 2 contact is again maintained by a jointing encirclement, but this is reversed with relation to the preceding one: the cam, itself completed this time by a second cam integral therewith, is now jointingly encircled by the two feet of a fork whose roller 2 forms one of the feet.

The two cams 1 and 13 are staggered in relation to each other axially along axis A and angularly thereabout.

According to a variation not shown, the mobile assembly carrying the rollers and urging these latter resiliently and dampingly against the cam is no longer provided pivoting, but sliding along an axis which intersects that of the cam perpendicularly thereto: in this case, the cam is preferably a single one and it is jointingly encircled by two rollers carried by the same slide, which is then subjected for each passage to reciprocal sliding.

Following which, and whatever the embodiment adopted, a passage control device is finally provided whose construction and operation follow sufficiently from what has gone before.

This device presents numerous advantages with respect to those previously known, in particular:

that of preventing any lift-off between cam and roller and any floating of the arms of the turnstile when they arrive in their stable position blocking the passage, and that of being indifferent to the direction of rotation of the turnstile.

As is evident, and as it follows moreover already from what has gone before, the invention is in no wise limited to those of its modes of application and embodiments which have been more specially considered; it embraces, on the contrary, all variations thereof, particularly that in which the number of the arms of the turnstile is other than three, for example equal to four.

I claim:

1. A turnstile for controlling the passage of people through a narrow opening by means of mechanical barriers adapted to obstruct at will this opening, comprising a rotary barriers-carrying member, and return means for automatically bringing the rotary member, after each passage causing retraction of a barrier, back towards a stable angular position in which a new barrier obstructs the passage, these return means comprising a first star-shaped cam angularly interlocked with the rotary member and a return roller, applied resiliently against this first cam, a second cam which delimits with the first cam a groove of constant width generally equal to the width of the said roller, thus adapted to jointingly encircle this roller, so that the directions of application of the roller against the respective cams are opposite, i.e. that the contact of the roller against the second cam opposes the loss of contact between the roller of the first cam, said roller being carried by a lever pivotally mounted about a lever axis parallel to the axes of the cams, said lever being associated, on the one hand, with resilient means for urging it angularly about said level axis in the direction corresponding to the application of the roller against the first cam, and on the other hand, with means for damping its angular movement.

2. A device as claimed in claim 1, wherein the turnstile is a three-arm turnstile and the active range of each cam presents three identical portions connected together and mutually staggard by 120° about the axis of the cam.

* * * * *